US010247041B2

(12) United States Patent
Scott

(10) Patent No.: US 10,247,041 B2
(45) Date of Patent: Apr. 2, 2019

(54) MULTI-PURPOSE MOUNTING

(71) Applicant: United Technologies Corporation, Hartford, CT (US)

(72) Inventor: Jonathan Ariel Scott, Southington, CT (US)

(73) Assignee: United Technologies Corporation, Farmington, CT (US)

( * ) Notice: Subject to any disclaimer, the term of this patent is extended or adjusted under 35 U.S.C. 154(b) by 503 days.

(21) Appl. No.: 14/441,537

(22) PCT Filed: Dec. 17, 2013

(86) PCT No.: PCT/US2013/075752

§ 371 (c)(1),
(2) Date: May 8, 2015

(87) PCT Pub. No.: WO2014/105525

PCT Pub. Date: Jul. 3, 2014

(65) Prior Publication Data

US 2015/0285099 A1 Oct. 8, 2015

Related U.S. Application Data

(60) Provisional application No. 61/747,229, filed on Dec. 29, 2012.

(51) Int. Cl.

| | |
|---|---|
| ***F01D 25/28*** | (2006.01) |
| ***F01D 25/16*** | (2006.01) |
| ***F01D 25/30*** | (2006.01) |

(52) U.S. Cl.

CPC ..... *F01D 25/28* (2013.01); *F01D 25/162* (2013.01); *F01D 25/285* (2013.01); *F01D 25/30* (2013.01);

(Continued)

(58) Field of Classification Search

CPC ..... F01D 25/28; F01D 25/285; F01D 25/30; F01D 25/162

See application file for complete search history.

(56) References Cited

U.S. PATENT DOCUMENTS 5,108,259 A * 4/1992 Wakeman ..... B64C 11/02 415/135
6,708,925 B2 * 3/2004 Udall ..... B64D 27/16 244/54

(Continued)

FOREIGN PATENT DOCUMENTS

| | | | |
|---|---|---|---|
| EP | 2251540 A2 | 11/2010 | |
| FR | 2940359 A1 * | 6/2010 | ..... F01D 25/28 |
| GB | 2226086 A | 6/1990 | |

OTHER PUBLICATIONS

European Office Action, for European Patent Application No. 13867850.3, dated Feb. 7, 2017, 5 pages.

(Continued)

*Primary Examiner* — Richard A Edgar
*Assistant Examiner* — Michael L Sehn
(74) *Attorney, Agent, or Firm* — Kinney & Lange, P.A.

(57) ABSTRACT

A frame employed in a turbine exhaust case of a gas turbine engine includes a frame outer ring, a frame inner ring, and a plurality of frame struts that connect the frame outer ring to the frame inner ring. The frame outer ring includes a plurality of bosses disposed circumferentially around the frame outer ring, wherein at least one of the plurality of bosses includes a mounting surface that receives and secures a removable bracket to the frame outer ring that supports a weight of the frame.

14 Claims, 6 Drawing Sheets

(52) U.S. Cl.
CPC ..... *F05D 2260/31* (2013.01); *Y10T 29/49826* (2015.01)

(56) References Cited

U.S. PATENT DOCUMENTS

| | | | |
|---|---|---|---|
| 2008/0014084 | A1 | 1/2008 | Eleftheriou et al. |
| 2008/0276621 | A1 | 11/2008 | Somanath et al. |
| 2010/0132376 | A1 | 6/2010 | Durocher et al. |
| 2010/0218508 | A1 | 9/2010 | Brown et al. |
| 2011/0016881 | A1 | 1/2011 | Ruiz et al. |
| 2012/0198815 | A1 | 8/2012 | Suciu et al. |
| 2012/0304811 | A1 | 12/2012 | Niggemeier et al. |

OTHER PUBLICATIONS

The International Search Report dated Apr. 15, 2014 for International Application No. PCT/US13/75752.
Extended European Search Report, for European Application No. 13867850.3, dated Apr. 8, 2016, 7 pages.

* cited by examiner

MULTI-PURPOSE MOUNTING

BACKGROUND

The present invention is directed to turbine exhaust cases (TECs) utilized in gas turbine engines, and in particular to mounts utilized in assembly and transporting of the TEC.

TECs typically comprise structural frames that support the very aft end of a gas turbine engine. In aircraft applications, the TEC can be utilized to mount the engine to the aircraft airframe. In industrial gas turbine applications, the TEC can be utilized to couple the gas turbine engine to an electrical generator. A typical TEC comprises an outer ring that couples to the outer diameter case of the low pressure turbine, an inner ring that surrounds the engine centerline so as to support shafting in the engine, and a plurality of struts connecting the inner and outer rings.

During various stages of manufacturing, the TEC must be lifted, supported, and positioned. This includes during assembly of the TEC, during transport of the TEC, and during assembly of the TEC to the rest of the gas turbine engine. Typically, depending on the manufacturing stage, various mounts are attached to different parts of the TEC to provide the desired support and/or positioning of the TEC. For example, in some instances a flanged portion of the TEC is used to secure the TEC for transport, while other portions of the TEC are used to support the TEC during assembly of TEC components. Multiple attachment points increases the cost of the TEC as well as increases the complexity associated with the manufacturing process, wherein the correct attachment point must be selected depending on the manufacturing stage.

SUMMARY

A frame employed in a turbine exhaust case of a gas turbine engine includes a frame outer ring, a frame inner ring, and a plurality of frame struts that connect the frame outer ring to the frame inner ring. The frame outer ring includes a plurality of bosses disposed circumferentially around the frame outer ring, wherein at least one of the plurality of bosses includes a mounting surface that receives and secures a removable bracket to the frame outer ring that supports a weight of the frame.

DETAILED DESCRIPTION

Figure 1:
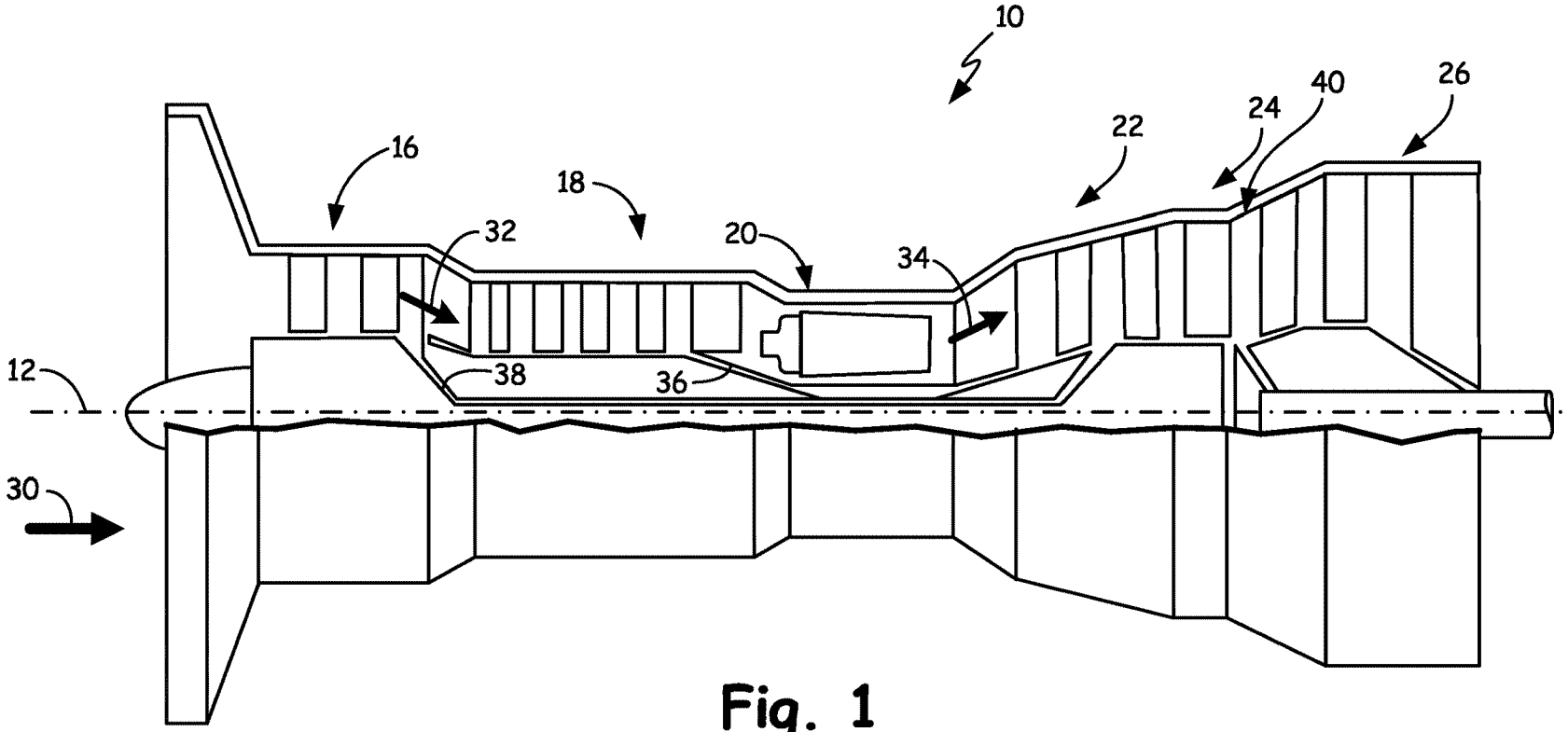
FIG. 1 is a side sectional schematic view of an industrial gas turbine engine having a turbine exhaust case.

FIG. 1 is a side partial sectional schematic view of gas turbine engine 10. In the illustrated embodiment, gas turbine engine 10 is an industrial gas turbine engine circumferentially disposed about a central, longitudinal axis or axial engine centerline axis 12 as illustrated in FIG. 1. Gas turbine engine 10 includes, in series order from front to rear, low pressure compressor section 16, high pressure compressor section 18, combustor section 20, high pressure turbine section 22, and low pressure turbine section 24. In some embodiments, power turbine section 26 is a free turbine section disposed aft of the low pressure turbine 24.

As is well known in the art of gas turbines, incoming ambient air 30 becomes pressurized air 32 in the low and high pressure compressor sections 16 and 18. Fuel mixes with pressurized air 32 in combustor section 20, where it is burned. Once burned, combustion gases 34 expand through high and low pressure turbine sections 22 and 24 and through power turbine section 26. High and low pressure turbine sections 22 and 24 drive high and low pressure rotor shafts 36 and 38 respectively, which rotate in response to flow of combustion gases 34 and thus rotate the attached high and low pressure compressor sections 18 and 16. Power turbine section 26 may, for example, drive an electrical generator, pump, or gearbox (not shown).

Low Pressure Turbine Exhaust Case (LPTEC) 40 is positioned between low pressure turbine section 24 and power turbine section 26. LPTEC 40 defines a flow path for gas exhausted from low pressure turbine section 24 that is conveyed to power turbine 26. LPTEC 40 also provides structural support for gas turbine engine 10 so as to provide a coupling point for power turbine section 26. LPTEC 40 is therefore rigid and structurally strong.

During various stages of manufacturing and assembly, each of these components must be supported in a manner that allows the components to be positioned for assembly. In addition, transportation of these components individually or as part of an assembled gas turbine engine requires means for securing the components to whatever machine or vehicle is handling the transportation. In at least one embodiment, during transportation gas turbine engine 10 is secured and/or supported by LPTEC 40.

It is understood that FIG. 1 provides a basic understanding and overview of the various sections and the basic operation of an industrial gas turbine engine. It will become apparent to those skilled in the art that the present application is applicable to all types of gas turbine engines, including those with aerospace applications. Similarly, although the present disclosure is described with reference to cooling arrangements employed in LPTEC 40, the present invention is applicable to other components of gas turbine engines, such as intermediate cases, mid-turbine frames and the like.

Figure 2A:
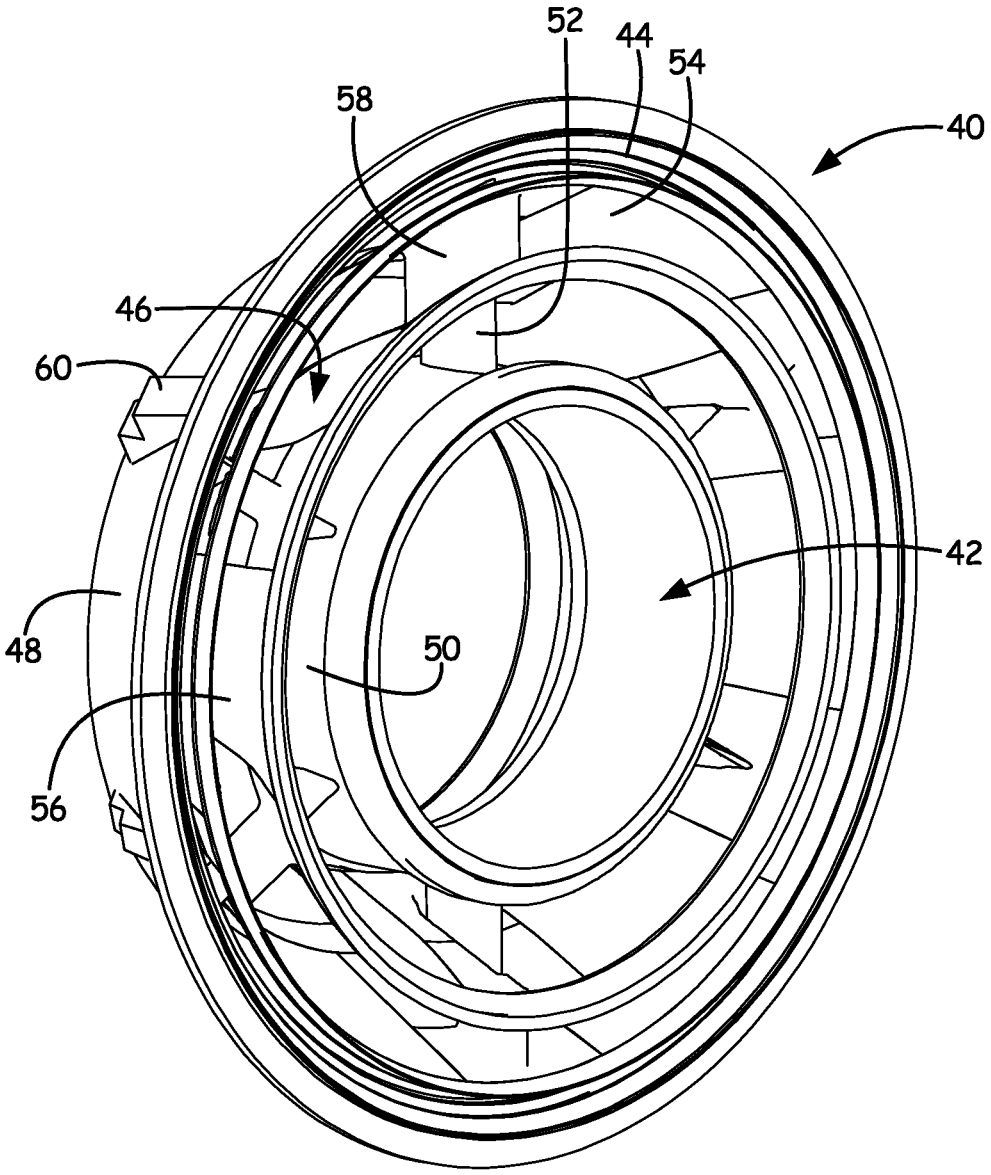
FIG. 2A is a perspective view of a turbine exhaust case in which a ring-strut-ring fairing is assembled with a ring-strut-ring frame.
Figure 2B:
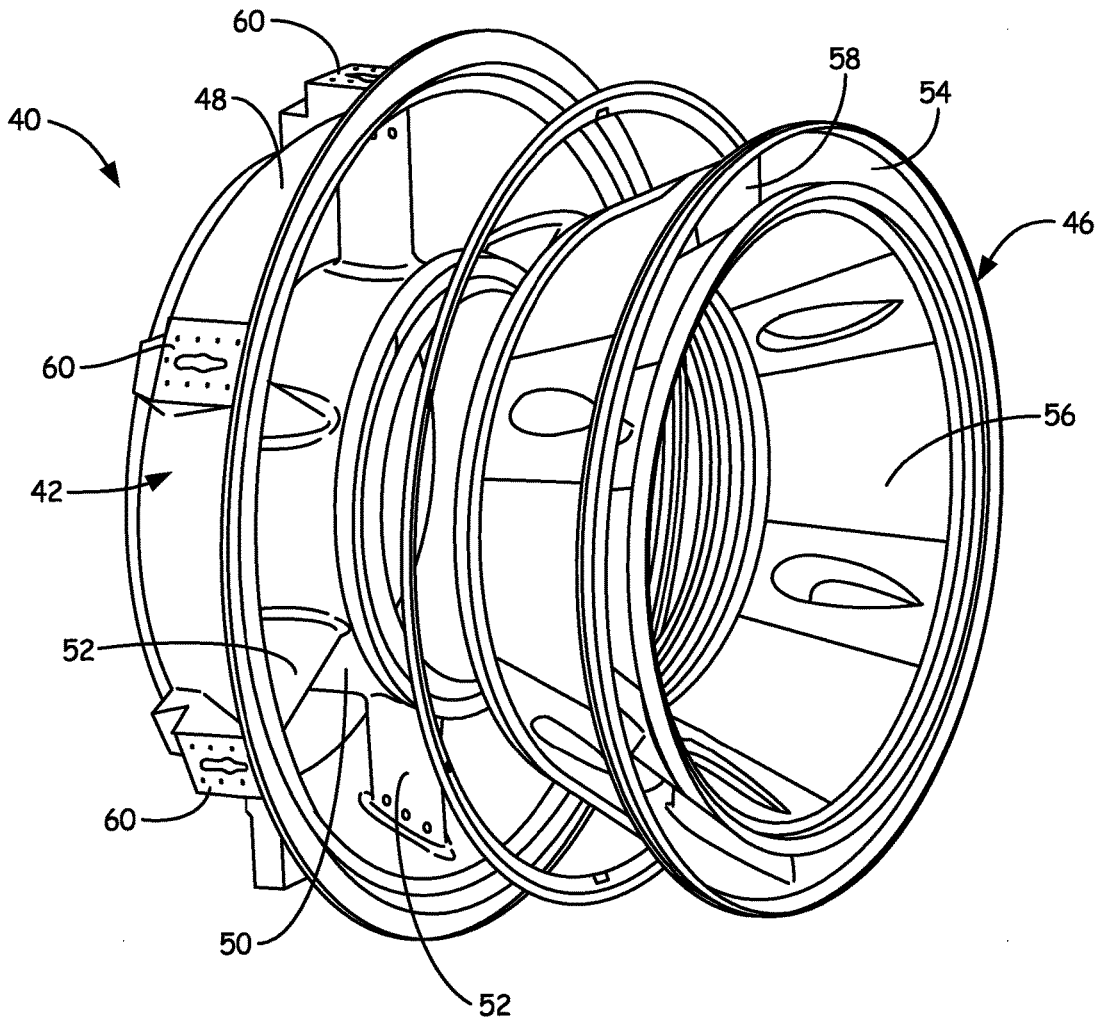
FIG. 2B is an exploded view of the turbine exhaust case of FIG. 2A showing the frame, the fairing and a circumferential stop ring.

FIG. 2A shows a perspective view of Low Pressure Turbine Exhaust Case (LPTEC) 40, which includes frame 42, annular mount 44, and fairing 46. FIG. 2B, which is discussed concurrently with FIG. 2A, shows an exploded view of LPTEC 40 that illustrates fairing 46 and a portion of frame 42. Frame 42 includes frame outer ring 48, frame inner ring 50, and frame struts 52. Fairing 46 includes fairing outer ring 54, fairing inner ring 56, and fairing struts 58. A plurality of bosses 60 (partially visible in FIGS. 2A and 2B) are disposed circumferentially around frame outer ring 48. As described in more detail with respect to FIGS. 3 and 4, these bosses are utilized, in one respect, to secure mounting brackets to frame 42.

Frame 42 comprises a ring-strut-ring structure that defines a load path between outer ring 48 and inner ring 50. Fairing 46 also comprises a ring-strut-ring structure that is mounted within frame 42 to form the gas path and protect frame 42 from high temperature exposure. In one embodiment, fairing 46 can be built around frame 42, and in another embodiment, frame 42 is built within fairing 46.

Frame 42 comprises a stator component of gas turbine engine 10 (FIG. 1) that is typically mounted between low pressure compressor section 24 and power turbine section 26. In the embodiment shown, outer ring 48 of frame 42 is conically shaped, while inner ring 50 is cylindrically shaped. Outer ring 48 is connected to inner ring 50 via struts 52. Outer ring 48, inner ring 50 and struts 52 form a portion of the load path through gas turbine engine 10 (FIG. 1). Specifically, outer ring 48 defines the outer radial boundaries of a load path between low pressure turbine section 24 and power turbine section 26 (FIG. 1). Fairing 46 is adapted to be disposed within frame 42 between outer ring 48 and inner ring 50. Fairing outer ring 54 and fairing inner ring 56 of fairing 46 have generally conical shapes, and are connected to each other by fairing struts 58. Fairing outer ring 54, fairing inner ring 56, and fairing struts 58, form a liner for the portion of the gas flow path through frame 42. Specifically, fairing struts 58 encase struts 52, while fairing outer ring 54 and fairing inner ring 56 line inward facing surfaces of outer ring 48 and inner ring 50, respectively.

Figure 3:
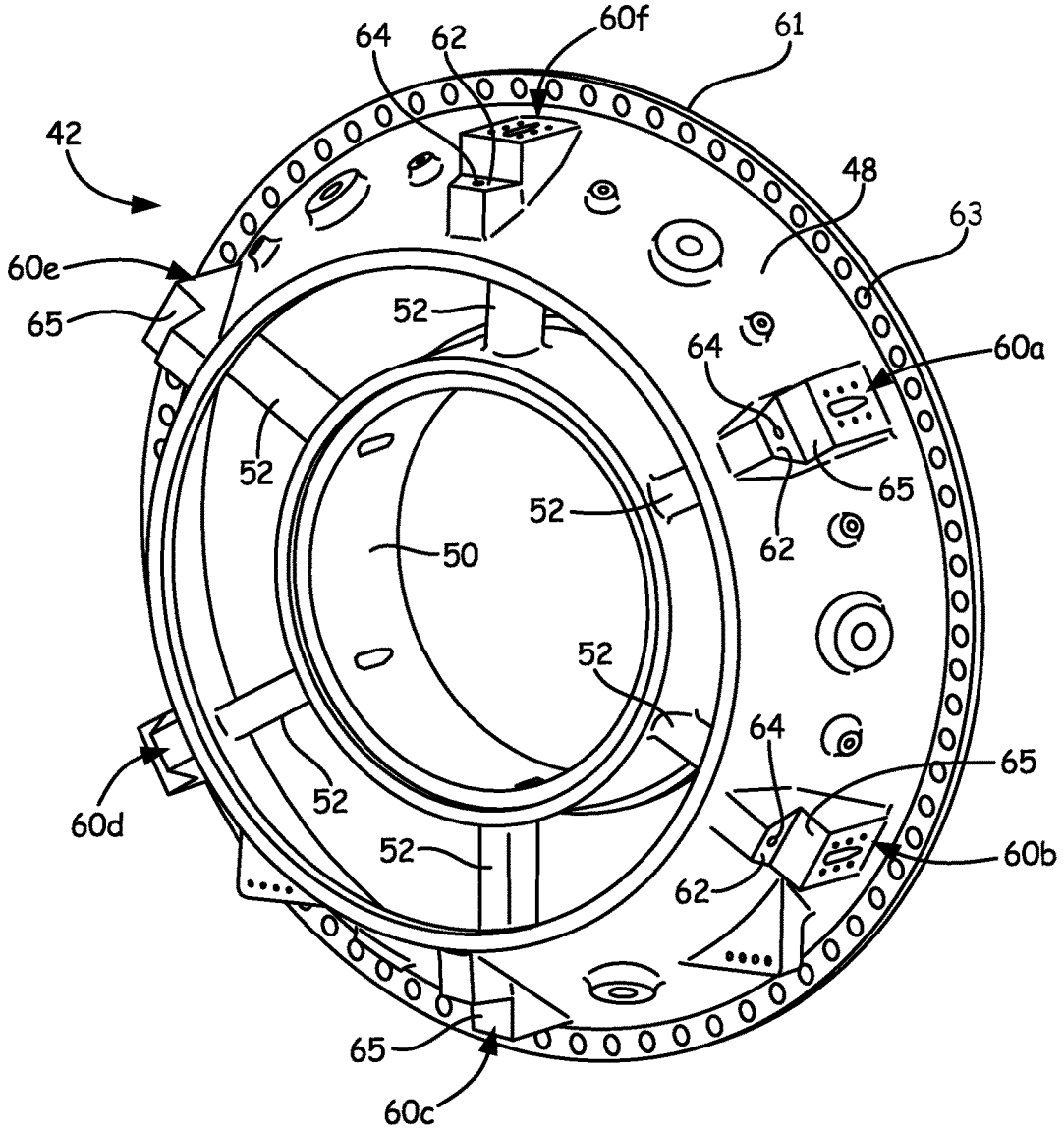
FIG. 3 is a perspective view of the frame employed in the turbine exhaust case according to an embodiment of the present invention.

FIG. 3 is a perspective view of frame 42 employed in LPTEC 40 according to an embodiment of the present invention. Frame 42 includes frame outer ring 48, frame inner ring 50, and frame struts 52. A plurality of bosses 60*a*, 60*b*, 60*c*, 60*d*, 60*e*, 60*f* (collectively, "bosses 60") are disposed circumferentially around frame outer ring 48. In the embodiment shown in FIG. 3, each of the plurality of bosses 60 are radially aligned with one of the plurality of frame struts 52, wherein the bosses provide structural support for securing the plurality of frame struts 52 to frame outer ring 48 and also provide a flat structure for connecting external pipes that are used to carry oil and cooling airflow through frame struts 52. In addition, each of the plurality of bosses 60 includes mounting surface 62, bolt hole 64, and anti-rotation surface 65.

In addition, frame outer ring 48 includes outer ring flange 61 located on the aft end of frame outer ring 48. Outer ring flange 61 includes a plurality of bolt holes 63 utilized during assembly to secure LPTEC 40 to adjacent components.

A mounting bracket (shown in FIG. 4) is mounted onto mounting surface 62 of at least one of the plurality of bosses 60 and secured to mounting surface 62 by a bolt provided through bolt hole 64. As discussed in more detail with respect to FIG. 6, the mounting bracket may also be mounted to outer ring flange 61 via the plurality of bolt holes 63. Anti-rotation surface 65 is positioned adjacent and perpendicular to mounting surface 62 and prevents a mounting bracket from rotating once secured to mounting surface 62 (assuming the mounting bracket has a straight edge that is aligned adjacent to and in contact or very nearly in contact with anti-rotation surface 65).

Figure 4:
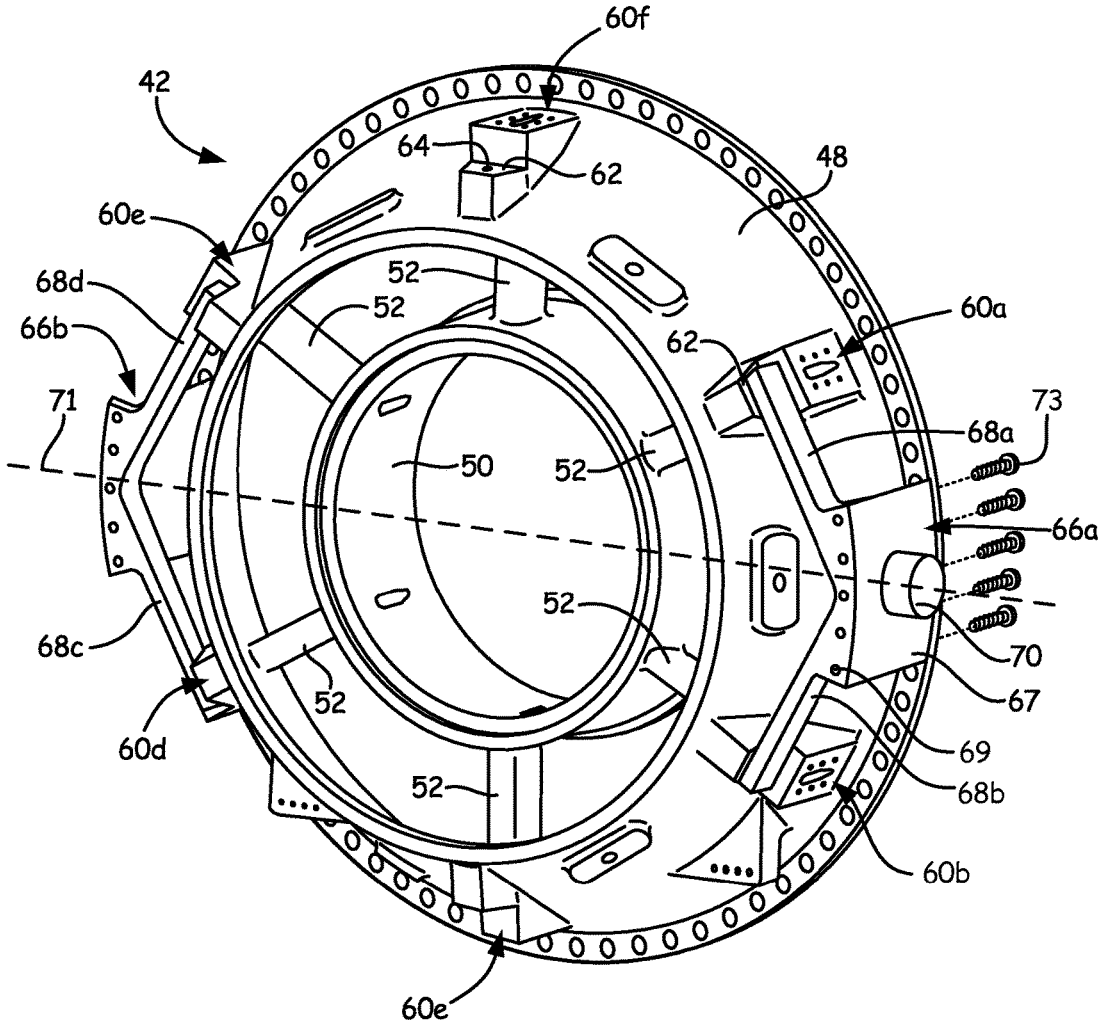
FIG. 4 is a perspective view of the frame with a mounting bracket installed according to an embodiment of the present invention.

FIG. 4 is a perspective view of frame 42 with mounting brackets 66*a* and 66*b* installed according to an embodiment of the present invention. In the embodiment shown in FIG. 4, mounting bracket 66*a* includes platform 67, first leg 68*a* and second leg 68*b*, and pivot support 70. Although partially hidden from view, mounting bracket 66*b* would likewise include a platform (not visible), first and second legs 68*c* and 68*d*, and a pivot support (not visible). In the embodiment shown in FIG. 4, platform 67 further includes a plurality of bolt holes 69. While illustrated in FIG. 4 as extending through platform 67, in some embodiments, bolt holes 69 may not extend entirely through platform 67, but may extend partially into and terminate within platform 67.

To differentiate between bosses 60, each individual boss 60 would be referred to as specifically as boss 60*a*, 60*b*, 60*c*, 60*d*, 60*e*, or 60*f*, although the components making up each boss are referred to generically. First leg 68*a* of mounting bracket 66*a* is connected to mounting surface 62 of boss 60*a*. Second leg 68*b* of mounting bracket 66*a* is connected to mounting surface 62 of boss 60*b*, which is adjacent to boss 60*a*. With respect to each, fasteners (e.g., bolts, not shown) would be provided to secure legs 68*a* and 68*b* to the respective mounting surfaces 62 associated with bosses 60*a* and 60*b*. Because of the alignment between first and second legs 68*a* and 68*b* and anti-rotation surfaces 65 on bosses 60*a* and 60*b*, respectively, once installed mounting bracket 66*a* is not able to rotate, even when loaded. Mounting bracket 66*b* is mounted via first and second legs 68*c* and 68*d* to mounting surfaces associated with bosses 60*d* and 60*e*, respectively. In the embodiment shown in FIG. 4, bolts 73 threaded through bolt holes 63 in outer ring flange 61 are secured to bolt holes 69 in platform 67 to further secure mounting bracket 66*a* (and 66*b*) to LPTEC 40.

Once installed, mounting brackets 66*a* and 66*b* are used to support the weight of frame 42, LPTEC 40, or at least a portion of gas turbine engine 10 depending on the stage of manufacturing and assembly. In the embodiment shown in FIG. 4, mounting brackets 66*a* and 66*b* utilize a total of four bosses. In other embodiments, various other mounting configurations may be utilized to support the weight of frame 42, LPTEC 40 and/or a portion of gas turbine engine 10. For example, during assembly of frame 42 (including only assembly of frame outer ring 48, frame inner ring 50 and frame struts 52), mounting brackets 66*a* and 66*b* may not be required. Rather a simple i-bolt or hook bolt may inserted in bolt hole 64 and utilized to support the weight of frame 42. One of the benefits of the present invention is that different types of mounting brackets may be attached to frame 42 utilizing the same mounting surface and/or bolt holes, depending on the requirements of a particular application.

In the embodiment shown in FIG. 4, pivot support 70 provides a point at which external supports/tooling can be connected to mounting bracket 66. In the embodiment shown in FIG. 4, pivot support 70 is cylindrical to allow frame 42 to be rotated about axis 71 defined between mounting brackets 66*a* and 66*b* (through pivot support 70 and the pivot support, not shown, associated with mounting bracket 66*b*). During assembly of LPTEC 40 with other components of gas turbine engine 10, the ability to pivot LPTEC 40 about axis 71 simplifies alignment between LPTEC 40 and other engine components.

During assembly of the components making up frame 42, mounting brackets 66*a* and 66*b* are secured to a plurality of bosses (e.g., mounting bracket 66*a* connected to bosses 60*a* and 60*b*, and mounting bracket 66*b* connected to bosses 60*d* and 60*e*). Frame 42 is supported via mounting brackets 66*a* and 66*b*, and specifically via pivot support 70 associated with mounting bracket 66*a* and another pivot support (not visible) associated with mounting bracket 66*b*. While supported via mounting brackets 66*a* and 66*b*, other components of frame 42 such as frame inner ring 50 and frame struts 52 may be connected to frame outer ring 48. In addition, components associated with fairing 46 may be installed as part of the assembly of LPTEC 40. Mounting brackets 66*a* and 66*b* may remain affixed to frame 42 to provide a handle for lifting/handling frame 42, as well as for securing frame 42 during transport. Alternatively, mounting brackets 66*a* and 66*b* may be removed and various other configuration of mounting brackets may be installed utilizing mounting surfaces 62 associated with the plurality of bosses 60. For example, in one embodiment one or more i-bolts may be utilized to provide one or more connection points for supporting and/or securing LPTEC 40, each i-bolt connected to one of the plurality of bolt holes 64 associated with the plurality of bosses 60. Mounting brackets such as mounting brackets 66*a* and 66*b* may be utilized even after LPTEC 40 has been assembled together with other components of gas turbine engine 10, with mounting brackets 66*a* and 66*b* being utilized to support at least a portion of gas turbine engine 10. Upon final installation, mounting brackets 66*a* and 66*b* are removed from frame 42.

Figure 5:
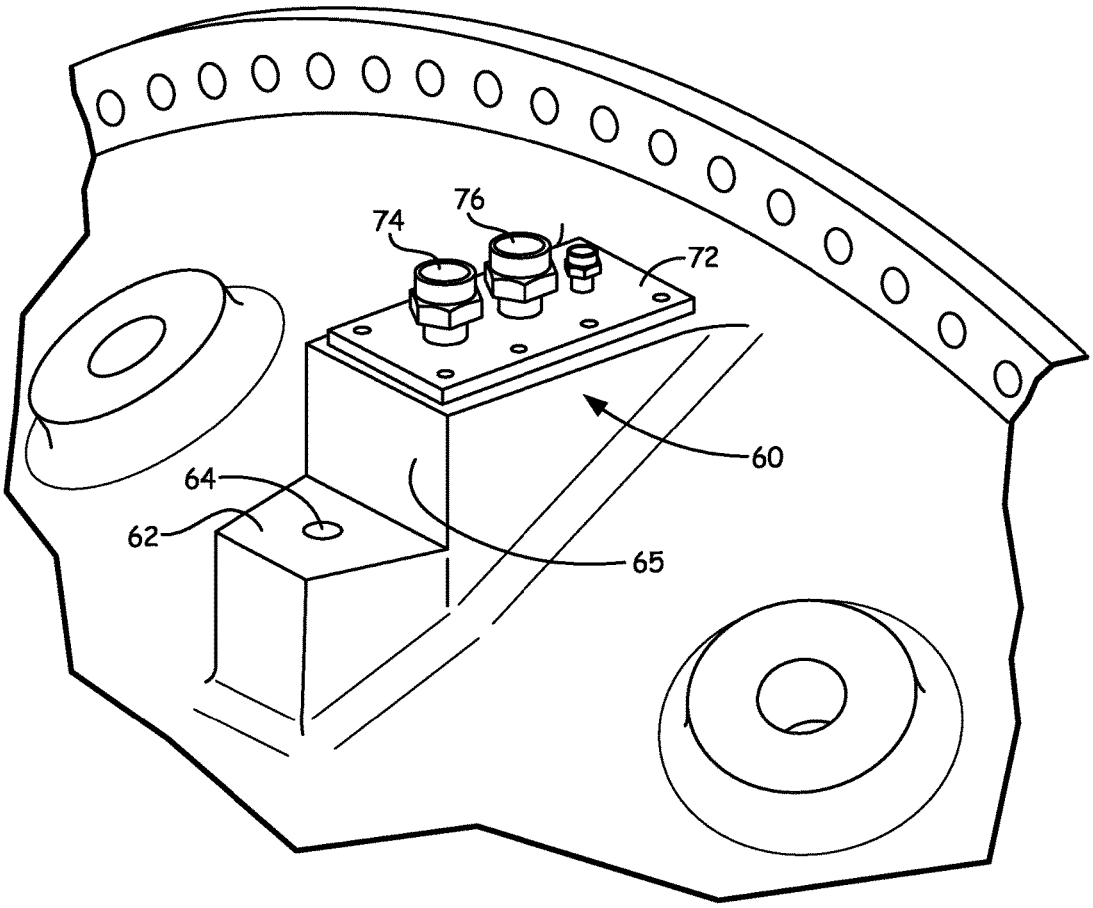
FIG. 5 is a perspective view of the boss located on the frame for receiving the mounting bracket according to an embodiment of the present invention.

FIG. 5 is a perspective view of boss 60*a* located on frame 42 that secures a mounting bracket according to an embodiment of the present invention. Boss 60*a* includes mounting surface 62, hole 64, anti-rotation surface 65, auxiliary surface 72, and service line connections 74 and 76. Mounting surface 62 is located forward of auxiliary surface 72, but on a plane approximately parallel with auxiliary surface 72. Anti-rotation surface 65 is disposed between mounting surface 62 and auxiliary service 72, and is approximately perpendicular to both mounting surface 62 and auxiliary surface 72. Hole 64 is located approximately in the middle of mounting surface 62.

A mounting bracket (not shown) is secured to mounting surface 62 via a fastener secured via hole 64 (e.g., a bolt). Anti-rotation surface 65 is positioned adjacent to mounting surface 62 and perpendicular to anti-rotation surface 65. In addition, anti-rotation surface 65 provides some space between hole 64 and service line connections 74 and 76 that prevents damage to these components during handling of LPTEC 40. In addition, anti-rotation surface 65 prevents the mounting bracket from being able to turn once installed, thereby providing a stable platform through which LPTEC 40 can be supported.

The following are non-exclusive descriptions of possible embodiments of the present invention.

A frame employed in a turbine exhaust case of a gas turbine engine includes a frame outer ring, a frame inner ring, and a plurality of frame struts that connect the frame outer ring to the frame inner ring. The frame outer ring includes a plurality of bosses disposed circumferentially around the frame outer ring, wherein at least one of the plurality of bosses includes a mounting surface that receives and secures a removable bracket to the frame outer ring that supports a weight of the frame.

The frame of the preceding paragraph can optionally include, additionally and/or alternatively, any one or more of the following features, configurations and/or additional components:

wherein each of the plurality of bosses is associated with one of the plurality of frame struts;

wherein the plurality of bosses include a fastener hole located in the mounting surface that receives a fastener for securing the removable bracket to the frame;

wherein the plurality of bosses include an anti-rotation surface located adjacent and perpendicular to the mounting surface to prevent rotation of a mounting bracket once installed.

A turbine exhaust case includes a frame and a mounting bracket. The frame includes a plurality of bosses disposed circumferentially around an outer surface of the frame. The mounting bracket includes a first end attached to one of the plurality of bosses and a second end attached to an adjacent boss. The mounting bracket is used to support the weight of the turbine exhaust case.

The turbine exhaust case of the preceding paragraph can optionally include, additionally and/or alternatively, any one or more of the following features, configurations and/or additional components:

wherein the mounting bracket includes a platform having a pivot support extending from the platform for connection to external support members;

wherein the plurality of bosses include a mounting surface having a fastener hole for securing the mounting bracket to the frame;

wherein the plurality of bosses include an anti-rotation surface located adjacent and perpendicular to the mounting surface to prevent rotation of the mounting bracket;

wherein the plurality of bosses are radially aligned with a plurality of frame struts connected between a frame outer ring and a frame inner ring.

A method of handling a turbine exhaust case (TEC) that includes a frame includes attaching a first end of a first mounting bracket to a first boss disposed on an outer surface of the frame. A second end of the first mounting bracket is attached to a second boss disposed adjacent to the first boss. At least a portion of the TEC is supported by the mounting bracket during assembly and/or transport of the TEC. The mounting bracket is then removed from the TEC.

The method of the preceding paragraph can optionally include, additionally and/or alternatively, any one or more of the following features, configurations and/or additional components:

attaching a first end of a second mounting bracket to a third boss disposed on the outer surface of the frame and attaching a second end of the second mounting bracket to a fourth boss disposed on the outer surface of the frame. The fourth boss is located adjacent to the third boss;

wherein the first mounting bracket is disposed approximately 180 degrees from the second mounting bracket.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A frame employed in a turbine exhaust case of a gas turbine engine, the frame comprising:

a frame outer ring that includes a plurality of bosses disposed circumferentially around the frame outer ring, wherein at least one of the plurality of bosses includes:

a mounting surface that receives and secures a removable bracket to the frame outer ring that supports a weight of the frame;

an anti-rotation surface located adjacent to the mounting surface, wherein the anti-rotation surface extends radially and is perpendicular to the mounting surface, and wherein the anti-rotation surface is configured to directly engage with the removable bracket to prevent rotation of the removable bracket once secured to the frame outer ring;

an auxiliary surface extending parallel to the mounting surface, wherein the mounting surface is radially and axially offset from the auxiliary surface; and a plurality of service line connections positioned on the auxiliary surface;

a frame inner ring; and a plurality of frame struts that connect the frame outer ring to the frame inner ring.

2. The frame of claim 1, wherein each of the plurality of bosses is associated with one of the plurality of frame struts.

3. The frame of claim 1, wherein the plurality of bosses each include a fastener hole located in the mounting surface for receiving a fastener to secure the removable bracket to the frame.

4. The frame of claim 1, wherein each of the plurality of bosses is radially aligned with one of the plurality of frame struts.

5. The frame of claim 1, wherein the anti-rotation surface extends from the mounting surface.

6. The frame of claim 5, wherein the anti-rotation surface extends from the mounting surface to the auxiliary surface.

7. A turbine exhaust case comprising:

a frame having a plurality of bosses disposed circumferentially around an outer surface of the frame; and a mounting bracket having a first end attached to one of the plurality of bosses and a second end attached to an adjacent boss, wherein the mounting bracket supports a weight of the turbine exhaust case;

wherein each of the plurality of bosses includes:

a mounting surface having a bolt hole for securing the mounting bracket to the frame;

an anti-rotation surface that extends radially and is perpendicular to the mounting surface, wherein the anti-rotation surface is configured to directly engage with the mounting bracket to prevent rotation of the mounting bracket;

an auxiliary surface extending parallel to the mounting surface, wherein the mounting surface is radially and axially offset from the auxiliary surface; and a plurality of service line connections positioned on the auxiliary surface.

8. The turbine exhaust case of claim 7, wherein the mounting bracket includes a platform having a pivot support extending from the platform for connection to external support members.

9. The turbine exhaust case of claim 7, wherein each of the plurality of bosses are radially aligned with one of a plurality of frame struts connected between a frame outer ring and a frame inner ring.

10. The turbine exhaust case of claim 7, wherein the anti-rotation surface extends from the mounting surface.

11. A method of handling a turbine exhaust case (TEC) that includes a frame, the method comprising:

attaching a first end of a first mounting bracket to a first mounting surface of a first boss disposed on an outer surface of the frame such that the first end of the first mounting bracket directly engages a first anti-rotation surface of the first boss located adjacent and perpendicular to the first mounting surface;

attaching a second end of the first mounting bracket to a second mounting surface of a second boss disposed on the outer surface of the frame adjacent to the first boss such that the second end of the second mounting bracket directly engages a second anti-rotation surface of the second boss located adjacent and perpendicular to the second mounting surface;

supporting at least a portion of the TEC via the first mounting bracket during assembly and/or transport of the TEC; and removing the first mounting bracket.

12. The method of claim 11, further including:

attaching a first end of a second mounting bracket to a third boss disposed on the outer surface of the frame; and attaching a second end of the second mounting bracket to a fourth boss disposed on the outer surface of the frame, wherein the fourth boss is adjacent to the third boss.

13. The method of claim 12, wherein the first mounting bracket is disposed approximately 180 degrees from the second mounting bracket.

14. The turbine exhaust case of claim 10, wherein the anti-rotation surface extends from the mounting surface to the auxiliary surface.

* * * * *